United States Patent [19]

Rudnick

[11] Patent Number: 4,539,096

[45] Date of Patent: Sep. 3, 1985

[54] PROCESS FOR RECOVERING OIL AND METALS FROM OIL SHALE

[75] Inventor: Leslie R. Rudnick, Lawrenceville, N.J.

[73] Assignee: Mobil Oil Corporation, New York, N.Y.

[21] Appl. No.: 631,685

[22] Filed: Jul. 16, 1984

[51] Int. Cl.[3] ..... C10G 1/00; C10G 17/06

[52] U.S. Cl. ..... 208/11 R; 208/254 R; 423/68

[58] Field of Search ..... 208/11 R, 254 R; 423/143, 150, 68, 56; 75/119, 115, 120

[56] References Cited

U.S. PATENT DOCUMENTS

| | | | |
|---|---|---|---|
| 1,991,049 | 2/1935 | Campbell | 208/254 R |
| 2,662,843 | 12/1953 | Castner et al. | 208/254 R |
| 2,692,226 | 10/1954 | Smith | 208/11 R |
| 2,704,758 | 3/1955 | Wetzel | 208/254 H |
| 2,756,122 | 7/1956 | McLean | 423/68 X |
| 3,055,825 | 9/1962 | Buningh et al. | 208/254 R |
| 3,087,809 | 4/1963 | Spence et al. | 423/68 |
| 3,888,966 | 6/1975 | Miller | 423/150 |
| 3,963,823 | 6/1976 | Kulkarni | 423/56 |
| 4,117,886 | 10/1978 | Honaker | 166/259 |
| 4,159,940 | 7/1979 | Smith | 208/254 R |
| 4,209,385 | 6/1980 | Stover | 208/254 R |
| 4,225,503 | 9/1980 | Hasegawa et al. | 423/68 |
| 4,268,378 | 5/1981 | Compton | 208/254 R |
| 4,324,039 | 5/1982 | Durai-Swamy | 208/11 R |

*Primary Examiner*—D. E. Gantz
*Assistant Examiner*—Glenn A. Caldarola
*Attorney, Agent, or Firm*—Alexander J. McKillop; Michael G. Gilman; Charles A. Malone

[57] ABSTRACT

A process for the recovery of oil and metal values from oil shale which includes the step of acid leaching in combination with selective extraction of nitrogen components from the resultant product shale oil. The extracted nitrogen rich stream can either be recycled or utilized for other purposes as desired.

28 Claims, 1 Drawing Figure

PROCESS FOR RECOVERING OIL AND METALS FROM OIL SHALE

FIELD OF THE INVENTION

The present invention relates to the recovering of hydrocarbonaceous materials or kerogen from bituminous or sedimentary rocks, in particular oil shales, where the shale is crushed and then retorted. Off gases which result from the retorting process are collected and the desirable components used to make a sulfuric acid which can be utilized in removing nitrogenous components from the shale oil.

BACKGROUND OF THE INVENTION

When shale oil is derived from oil shale several problems are presented. One problem has to do with the disposal of reactants resulting from the shale oil retorting process. In the retorting process, reactants such as hydrogen sulfide, carbon oxides and spent shale present special problems for disposal. Contained in spent shale are some strategic metals. It is beneficial to recover these metals. These strategic metals include uranium, cobalt, nickel, niobium, aluminum, iron, manganese, chromium, and vanadium, etc. Others have provided methods for disposal of the reactants resulting from oil retorting processes. Still others have reclaimed strategic metals which are found in the oil shale matrix.

Stover, in U.S. Pat. No. Re. 31,363, reissued Aug. 30, 1983, sought to provide a method for reducing the nitrogen content of shale oil by selectively removing therefrom nitrogen-containing compounds. The nitrogen content of shale was reduced by contacting the shale oil with a sufficient amount of a solvent which was selective toward the nitrogen-containing compounds present in the shale oil. This solvent was a mixture comprised of an organic acid and a mineral acid. The mineral acid was selected from the group consisting of hydrochloric acid, nitric acid, nitrous acid, sulfuric acid, sulfurous acid, phosphoric acid and mixtures thereof.

In U.S. Pat. No. 4,117,886, issued to Honaker, on Oct. 3, 1978, a method was disclosed for removing acidic impurities from off-gases generated in the retorting of oil shale. This included contacting a rubblized mass of oil shale which had been substantially depleted in hydrocarbonaceous material with water, so as to extract components from the mass. Subsequently, off-gases, which were generated during the retorting of oil shale and which contained acidic impurities, were contacted with the water containing basic components so as to substantially remove the acidic impurities from said off-gases.

Smith, in U.S. Pat. No. 4,159,940, issued July 3, 1979 provided a method for removing nitrogen from an essentially liquid syncrude feed obtained from at least one of oil shale, tar sands, and coal wherein the snycrude was mixed with an acid selected from the group consisting sulfuric, phosphoric, hydrochloric, and combinations thereof. From this mixture a first phase was settled which was composed of syncrude low in nitrogen and a second phase composed of acid and syncrude high in nitrogen. These two phases were separated and the high nitrogen containing phase was catalytically hydrotreated to reduce its nitrogen content.

In another method, kerogen-containing shale was crushed and comminuted to a fineness sufficient to free kerogen and sulphides present in said shale. To enable the shale to be finely divided more readily, the crushed shale was subjected to a leaching treatment prior to final communition thereof. This patent issued as U.S. Pat. No. 4,176,042 on Nov. 27, 1979 to Falström.

None of the above methods provided an integrated method for disposing of undesired reactant products from the retorting process and using those undesired reactant products in combination with the product shale oil and spent shale. Moreover, providing a nitrogen rich oil, created via the retorting process and hydrogenated to serve as a solubilizing agent for oil shale in a retorting process was not provided for.

SUMMARY OF THE INVENTION

This invention provides for an integrated method to utilize undesired reactant products resultant from an oil shale retorting process. As a result, strategic mineral values in spent shale are recovered. In addition to recovering increased volumes of hydrocarbonaceous materials from oil shale, nitrogenous components in shale oil are utilized. Nitrogen-containing components in the product shale oil are extracted therefrom by an internally produced sulfuric acid. A portion of the sulfuric acid is used in combination with leaching the spent shale to provide for the recovery of additional metal values.

In the practice of this invention, oil shale is retorted under oil shale retorting conditions. Thereafter, a product shale oil which contains nitrogen components therein is obtained from the retorting process. Off gas which results from the reaction during the retorting process is oxidized and hydrolyzed to form sulfuric acid. One portion of the sulfuric acid is contacted with the product shale oil. Contact with the sulfuric acid causes the nitrogen-containing components to be removed from the product shale oil. Another portion or fraction of the sulfuric acid is contacted with the spent oil shale and spent oil shale fines. This causes some mineral values to be extracted from the spent shale and fines. After leaching with the sulfuric acid, the spent oil shales and fines are extracted with an amine solution to recover additional metal values. The nitrogen-containing fraction or portion of the product shale oil is hydrogenated and recycled into the oil shale retorting process to aid in the solubilization of the oil shale. As desired, the nitrogen-containing product shale oil can be removed and utilized in other ways to take advantage of nitrogenous components contained in the product shale oil therein.

It is therefore an object of the present invention to obtain strategic metal values from spent oil shale.

Still another object of the present invention is to obtain increased volumes of hydrocarbonaceous materials from a retorting process.

It is yet a further object of the present invention to obtain nitrogen-containing compounds from the shale oil and use them as hydrogen donors in the retorting of oil shale.

A still further object of the present invention is to reduce the cost of mining oil shale by recovering the metal values from oil shale.

BRIEF DESCRIPTION OF THE DRAWING

The drawing is a schematic representation of one embodiment of the invention.

DETAIL DESCRIPTION OF THE INVENTION

Figure 1:
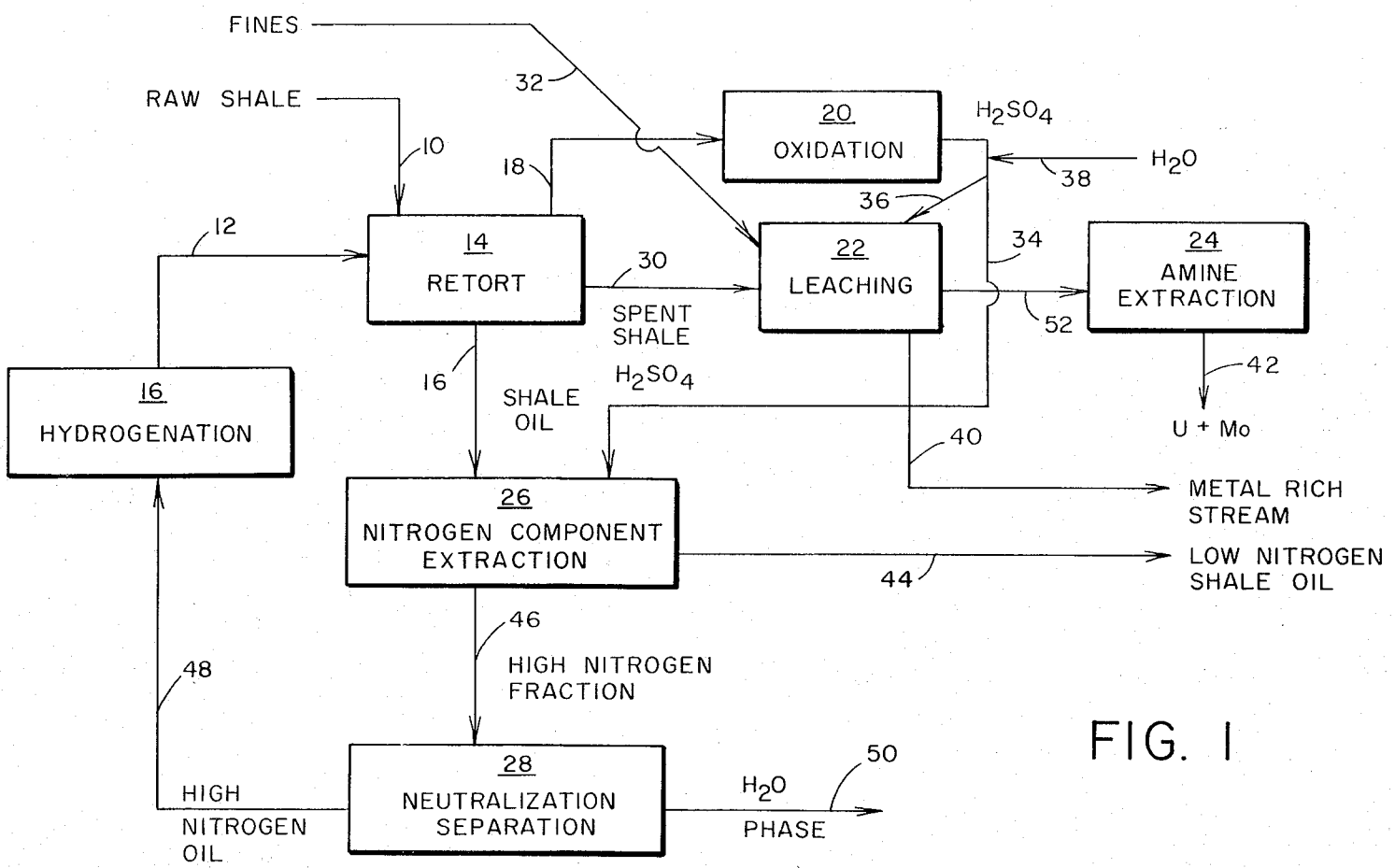

This invention is directed to an integrated method for removing nitrogen-containing components from product shale oil by an internally produced sulfuric acid. A portion of the sulfuric acid is used to leach the spent shale and spent shale fines to recover mineral values therefrom.

As depicted in the drawing, raw shale enters retort 14 via line 10. Also entering the retort, in this embodiment, is hydrogenated, nitrogen rich product shale oil obtained from the retorting process. This hydrogenated, nitrogen rich product shale oil enters the retort via line 12. While retorting the oil shale, under oil shale retorting conditions, off gas leaves the retort 15 via line 18 and proceeds to the oxidation step 20. Methods for retorting oil shale are disclosed in U.S. Pat. No. 4,209,385 issued to Stover on June 24, 1980. This patent is hereby incorporated by reference. Hydrogen sulfide in the off gas is oxidized to produce sulfuric acid by methods known to those skilled in the art. Additional water as required is added to the sulfuric acid emitted from line 34 to obtain the desired concentration of sulfuric acid. The water is added via line 38. Spent hot oil shale and shale fines leave the retort 15 via line 30 and 32 respectively where they enter the leaching step 22. Also entering the leaching step 22 are the fines from line 32. These fines and spent shale are leached via sulfuric acid which is of a strength and in an amount sufficient to remove the mineral values therefrom, generally from about 1.0 molar to about 18 molar, preferably about 4 molar. In those situations where it is desired, and where sufficient sulfuric acid cannot be produced internally, hydrochloric acid can be used to leach the spent shale and fines. When hydrochloric acid is used, the hydrochloric acid should be of the strength of from about 1 molar, to about 12 molar, preferably about 4 molar.

During the extraction step, various metals are removed from the spent shale and shale fines, these metals are contained in both the western and eastern shales, these metals include cobalt, chromium, nickel, niobium, uranium, aluminum, iron and vanadium, among others. Leachate resultant from this acid extraction step is substantially rich in metal values. Although it has been mentioned to use hydrochloric acid, as is known to those skilled in the art, sulfuric acid is perhaps more desirable since it is less corrosive and readily available from the oxidation of the process gas or off gas which contains hydrogen sulfide. After being leached, with preferably the sulfuric acid, the fines and spent shale are removed from the leaching step 22 and are directed via line 52 into an amine extraction step 24.

During the amine extraction step, an amine is used to remove additional metal values from the fines and spent shale. Equal weights of the amine solution and the fines combined with the spent shale are mixed. The mixing is carried out at about 100° F. and atmospheric pressure. Amines suitable for use in the extraction step include benzyl amines, preferably benzyl-alkyl amines. The strength of the amine solution used in the extraction step can vary from about 0.1 molar to about 5.0 molar, preferably about 0.5 molar.

The amine solution is contacted with the spent shale and shale fines for a time sufficient to remove the metal values therefrom. Generally, this will be from about 1 hour to about 12 hours, preferably about 5–8 hours. After a sufficient time has elapsed, the amine extract, which is rich in the metal values, is removed from the extraction step 24 via line 42 and further processed. Metal values contained in the extract include uranium and molybdenum.

Shale oil produced during the retorting step is removed from retort 14 via line 16. This product shale oil contains approximately about 2.1 percent nitrogen by weight. Afterwards, this product shale oil is directed into a nitrogen extraction step 26 via line line 16. Here the product shale oil is contacted with the internally produced sulfuric acid which enters the nitrogen extraction step 26 via line 34. The strength of the sulfuric acid utilized will be from about 1 molar to about 18 molar, preferably about 4 molar. As is preferred, the product shale oil is contacted with said sulfuric acid in a ratio of from about 0.10 to about 20 parts per volume of product shale oil to about 1.0 part per volume of sulfuric acid.

The product shale oil remains in the extraction step 26 for a time sufficient to remove the nitrogen-containing components therefrom. Generally, this time will be from about 15 minutes to about 120 minutes, preferably about 60 minutes. After remaining in the extraction step 26 for about 60 minutes, the high nitrogen containing fraction is removed from the nitrogen extraction step 26 via line 46. Subsequently the high nitrogen fraction is directed via line 46 into a neutralization separation step 28. The nitrogen content of the high nitrogen fraction extracted from the product shale oil will generally be from about 2.0 to about 12.0 percent by weight of nitrogen, preferably about 7.5 percent. After the neutralizaton separation step 28, water is removed from the neutralization separation step via line 50.

High nitrogen-containing oil which leaves the neutralization step 28 via line 48 can be hydrogenated in step 16. This hydrogenated high nitrogen oil can then be recycled via line 12 into retort 14 for use as a hydrogen donor component. When used in this manner, the hydrogenated high nitrogen oil can also assist in the solubilization of the oil shale during the retorting process. U.S. Pat. No. 4,159,940 issued to Smith on July 3, 1979 describes a hydrogenation method. This patent is hereby incorporated by reference. Instead of hydrogenating and recycling the high nitrogen product shale oil, this oil can be removed and the nitrogen containing components selectively removed therefrom for commercial use in other applications as required.

Low nitrogen shale oil is removed from the nitrogen extraction step 26 via line 44. This low nitrogen shale oil contains from about 0.1 to about 2.0 wt. percent nitrogen.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

What is claimed is:

1. A method for recovering hydrocarbonaceous materials from minerals containing same, particularly oil shale, under oil shale retorting conditions where a nitrogen containing product shale oil has nitrogen components extracted therefrom by an internally produced mineral acid which is also used to leach spent shale to recover minerals comprising the steps of:

(a) retorting under oil shale retorting conditions;

(b) obtaining from the retorting step a product shale oil which contains nitrogen components therein;

(c) producing sulfuric acid from a hydrogen sulfide containing off gas generated from the retorting step;
(d) contacting a portion of said sulfuric acid with product shale oil and extracting therefrom a substantially high nitrogen-containing fraction and a substantially low nitrogen-containing shale oil; and
(e) hydrogenating and recycling said substantially high nitrogen-containing fraction into the oil shale retort under oil shale retorting conditions to obtain increased amounts of hydrocarbonaceous materials.

2. The method as recited in claim 1 where in step (d) the product shale oil is contacted with said sulfuric acid in a ratio of from about 0.1 part by volume to about 20 parts by volume of product shale oil to about 1.0 part by volume of sulfuric acid.

3. The method as recited in claim 1 where in step (d) the product shale oil is contacted with sulfuric acid for a time sufficient to remove the nitrogen-containing components therefrom.

4. The method as recited in claim 1 where in step (d) the sulfuric acid is of a strength of from about 1 molar to about 18 molar.

5. The method as recited in claim 1 where in step (d) the substantially high nitrogen-containing fraction has a nitrogen content of from about 2 to about 12 percent by weight.

6. The method as recited in claim 1 where in step (d) the substantially low nitrogen shale oil contains from about 0.1 to about 2.0 weight percent nitrogen.

7. A method for recovering hydrocarbonaceous materials from minerals containing same, particularly oil shale, under oil shale retorting conditions where a nitrogen containing product shale oil has nitrogen components extracted therefrom by an internally produced mineral acid which is also used to leach spent shale to recover minerals comprising the steps of:
(a) retorting under oil shale retorting conditions;
(b) obtaining from the retorting step a product shale oil which contains nitrogen components therein;
(c) producing sulfuric acid from a hydrogen sulfide containing off gas generated from the retorting step;
(d) contacting a portion of said sulfuric acid with product shale oil and extracting therefrom a substantially high nitrogen-containing fraction and a substantially low nitrogen-containing shale oil;
(e) contacting another portion of said sulfuric acid with spent oil shale and fines thereof to leach metal values therefrom; and
(f) hydrogenating and recycling said substantially high nitrogen-containing fraction into the oil shale retort under oil shale retorting conditions to obtain increased amounts of hydrocarbonaceous materials.

8. The method as recited in claim 7 where in steps (d) and (e) the product shale oil is contacted with said sulfuric acid in a ratio of from about 0.1 parts by volume to about 20 parts by volume of product shale oil to about 1.0 part by volume of sulfuric acid.

9. The method as recited in claim 7 where in step (d) the product shale oil is contacted with sulfuric acid for a time sufficient to remove the nitrogen-containing components therefrom.

10. The method as recited in claim 7 where in step (e) the shale oil is contacted with about 4 molar sulfuric acid in a ratio of from about 0.1 to about 20 parts per volume of shale oil to about 1 part per volume of sulfuric acid for a time and temperature sufficient to remove metal values therefrom.

11. The method as recited in claim 7 where in step (e) said spent shale is contacted with about 4 molar sulfuric acid in a ratio of from about 0.1 to about 20 parts per volume of shale oil to about 1 part per volume of sulfuric acid for about 15 minutes to about 120 minutes.

12. The method as recited in claim 7 where in steps (d) and (e) the sulfuric acid is of a strength of from about 1 molar to about 18 molar.

13. The method as recited in claim 7 where in step (d) the substantially high nitrogen-containing fraction has a nitrogen content of from about 2 to about 12 percent by weight.

14. The method as recited in claim 7 where in step (d) the substantially low nitrogen shale oil contains from about 0.1 to about 2.0 weight percent nitrogen.

15. The method as recited in claim 7 where in step (e) the spent shale and fines are contacted with an amine solution in a concentration of from about 0.1 to about 5.0 molar to extract metal values therefrom after being initially contacted with the sulfuric acid.

16. The method as recited in claim 15 where the amine solution is from a group comprising benzyl amines.

17. The method as recited in claim 7 where in step (e) the leachate resultant from contact of the shale fines and spent shale with the sulfuric acid is substantially rich in metal values, which metal values include cobalt, aluminum, chromium, niobium, iron, manganese, nickel, vanadium, and uranium.

18. A method for recovering hydrocarbonaceous materials from minerals containing same, particularly oil shale, under oil shale retorting conditions where a nitrogen containing product shale oil has nitrogen components extracted therefrom by an internally produced mineral acid which is also used to leach spent shale to recover minerals comprising the steps of:
(a) retorting under oil shale retorting conditions;
(b) obtaining from the retorting step a product shale oil which contains nitrogen components therein;
(c) producing sulfuric acid from a hydrogen sulfide containing off gas generated from the retorting step;
(d) contacting a portion of said sulfuric acid with product shale oil and extracting thereform a substantially high nitrogen-containing fraction and a substantially low nitrogen-containing shale oil;
(e) contacting another portion of said sulfuric acid with spent oil shale and fines thereof to leach metal values therefrom;
(f) extracting said spent shale and fines with an amine solution under conditions suitable for extracting metals therefrom after leaching said spent shale and fines with sulfuric acid; and
(g) hydrogenating and recycling said substantially high nitrogen-containing fraction into the oil shale retort under oil shale retorting conditions to obtain increased amounts of hydrocarbonaceous materials.

19. The method as recited in claim 18 where in steps (d) and (e) the product shale oil is contacted with said sulfuric acid in a ratio of from about 0.1 part by volume to about 20 parts by volume of product shale oil to about 1.0 part by volume of sulfuric acid.

20. The method as recited in claim 18 where in step (d) the product shale oil is contacted with sulfuric acid for a time sufficient to remove the nitrogen-containing components therefrom.

21. The method as recited in claim 18 where in step (e) the shale oil is contacted with about 4 molar sulfuric acid in a ratio of from about 0.1 to about 20 parts per volume of shale oil to about 1 part per volume of sulfuric acid for a time and temperature sufficient to remove metal values therefrom.

22. The method as recited in claim 18 where in step (e) said spent shale is contacted with about 4 molar sulfuric acid in aratio of from about 0.1 to about 20 parts per volume of shale oil for about 15 minutes to about 120 minutes.

23. The method as recited in claim 18 where in steps (d) and (e) the sulfuric acid is of a strength of from about 1 molar to about 18 molar.

24. The method as recited in claim 18 where in step (d) the substantially high nitrogen-containing fraction has a nitrogen content of from about 2.0 to about 12 percent by weight.

25. The method as recited in claim 18 where in step (d) the substantially low nitrogen oil shale contains from about 0.1 to about 2.0 weight percent nitrogen.

26. The method as recited in claim 25 where in step (f) the amine solution is from a group comprising benzyl amines.

27. The method as recited in claim 18 where the amine solution is in a concentration of from about 0.1 to about 5.0 molar.

28. The method as recited in claim 26 where in step (e) the leachate resultant from contact of the shale fines and spent shale with the sulfuric acid is substantially rich in metal values, which metal values include cobalt, aluminum, chromium, niobium, iron, manganese, nickel, vanadium and uranium.

* * * * *